US006427474B1

(12) United States Patent
Le Boucher et al.

(10) Patent No.: US 6,427,474 B1
(45) Date of Patent: Aug. 6, 2002

(54) HYDRAULIC SUPPLY ASSEMBLY AND INSTALLATION EQUIPPED WITH SAME

(75) Inventors: Philippe Le Boucher, Cerisiers; Marc d'Alençon, Auxerre, both of (FR)

(73) Assignee: TEFA, Auxerre (FR)

( * ) Notice: Subject to any disclaimer, the term of this patent is extended or adjusted under 35 U.S.C. 154(b) by 0 days.

(21) Appl. No.: 09/763,475

(22) PCT Filed: Aug. 18, 1999

(86) PCT No.: PCT/FR99/01998

§ 371 (c)(1),
(2), (4) Date: Apr. 13, 2001

(87) PCT Pub. No.: WO00/11408

PCT Pub. Date: Mar. 2, 2000

(30) Foreign Application Priority Data

Aug. 21, 1998 (FR) ..... 98 10638

(51) Int. Cl.[7] ..... F25D 17/02; F25D 17/00; F24D 3/02

(52) U.S. Cl. ..... 62/434; 62/183; 237/63

(58) Field of Search ..... 62/430, 434, 183; 237/63

(56) References Cited

U.S. PATENT DOCUMENTS

| | | | | | |
|---|---|---|---|---|---|
| 2,598,966 | A | * | 6/1952 | Becker | 237/63 |
| 2,832,569 | A | * | 4/1958 | Lewis | 237/63 |
| 3,249,303 | A | * | 5/1966 | Townsend | 237/63 |
| 3,278,122 | A | * | 10/1966 | Laing | 237/63 |
| 4,513,580 | A | * | 4/1985 | Cooper | 62/183 |
| 4,620,984 | A | * | 11/1986 | Hoddinott | 427/9 |

FOREIGN PATENT DOCUMENTS

| | | | |
|---|---|---|---|
| DE | 1 205 254 | | 6/1959 |
| FR | 2 545 587 | | 11/1984 |
| FR | 2545587 | A * | 11/1984 |

* cited by examiner

*Primary Examiner*—William C. Doerrler
(74) *Attorney, Agent, or Firm*—Greer, Burns & Crain, Ltd.

(57) ABSTRACT

The invention concerns an assembly wherein a tank connects a return orifice to a delivery conduit via pumps. The tank is further connected to a surge tank. The tank is mounted in a steam proof chamber heat-insulated inside but having an air gap separation around the tank. Components are mounted sealed through the chamber. A filter subdivides the tank into a lower return chamber and a higher starting chamber.

28 Claims, 6 Drawing Sheets

HYDRAULIC SUPPLY ASSEMBLY AND INSTALLATION EQUIPPED WITH SAME

DESCRIPTION

The present invention relates to a hydraulic supply device for a closed-circuit installation.

The present invention also relates to such an installation.

The installations targeted by the invention are in particular heating and/or cooling installations in which a heat transfer fluid flows along a closed circuit in order to pass successively through a heat or coldness production equipment, a utilising device, a pump, a buffer tank, a filter, etc.

It can be a heating installation, a cooling installation, or else an installation which can operate either as a heating or as a cooling installation, the thermal source then consisting of e.g. a reversible refrigerating machine, that is to say one capable of operating either as a heating means or as a cooling means.

The object of the present invention is to rationalise installations of the said type with regard to their components other than their utilising devices.

According to the invention, the hydraulic supply device for an installation using a heat transfer fluid in a closed circuit, this device comprising the following components for the heat transfer fluid:

a tank having a return orifice and a feed orifice, a filter, a pump, an expansion vessel, is characterised by furthermore comprising an enclosure which houses at least part of said components while bringing them together in order to form a hydraulic unit.

Preferably, the enclosure is substantially fluid-tight. In this way substantial entries of water vapour into the enclosure and consequently the problems of condensation on the outside face of the wall of the tank are prevented.

It is also preferred that the enclosure should carry on its inside face a heat insulating lining. Such an internal lining is much easier to produce than external lagging on components having complex shapes such as tanks, pumps and their interconnecting pipes. The enclosure being thus internally insulated makes it possible to dispense with heat insulation on the components housed in the enclosure.

In particular, if the enclosure is substantially fluid-tight, the heat insulating lining can be made from a material which is not intrinsically fluid-tight, such as rock wool. Such a material is inexpensive and easy to apply. Thanks to the fluid-tightness of the enclosure there is no risk of it being saturated with water.

Preferably, between the inside face of the heat insulating lining and the outside face of the components housed in the enclosure, there is a space filled with air which constitutes additional insulation.

The arrangement of components inside the enclosure is such that possible condensates can flow without wetting the insulating lining.

According to an important feature of the invention, the filter is fitted inside the tank like a permeable partition subdividing the inside of the tank into a return chamber connected to the return orifice and a feed chamber connected to the feed orifice. This arrangement has multiple advantages. It eliminates the necessity of providing a location and a fitting for the filter in the circuit outside of the tank. Furthermore, in the tank, the filter has a large diameter and thus offers a negligible head loss. Similarly, for a closed circuit installation, where clogging prominently occurs just after the first operation, a filter of such size proves capable of stopping the initial impurities and then of continuing to allow normal operation without having to be cleaned.

If the return chamber is in the low position under the feed chamber, the impurities in any case have a tendency to fall to the bottom of the return chamber instead of remaining suspended on the bottom surface of the filter.

One of the important optional features of the present invention consists in fitting certain of the components such that they traverse the wall of the enclosure. In particular the pump or pumps are preferably fitted in such a way that the motor is outside of the enclosure. In this way the motor is ventilated better and the heat dissipated by the motor is prevented from heating up the inside of the enclosure, which is undesirable when the function of the installation is to cool the utilising devices.

It is also possible to fit the expansion vessel such that it traverses the wall of the enclosure in such a way that its adjustment device is accessible from outside of the enclosure.

It is also possible chat a flow-regulating valve installed downstream of the pump be so mounted that said valve extends through the wall of the enclosure.

It is advantageous that all of the components thus fitted such that they traverse the wall of the enclosure are grouped on one and the same side of the enclosure forming the back of a compartment adjacent to the enclosure itself.

Such a compartment can assume the form of a cabinet in which the electrical box is also installed.

If the return and feed orifices of the tank are oriented at about 90° with respect to each other, the feed path, making a 90° turn because of the usual geometry of pumps such as centrifugal ones, can exit on the same side of the enclosure as that through which the return path passes. This favours a rational connection with the rest of the installation.

According to a second subject of the invention, the heating and/or cooling installation comprising, along a closed circuit of heat transfer fluid:

a hydraulic supply device, at least one thermal source, at least one utilising device, is characterised in that the supply device conforms with the first aspect.

Other features and advantages of the invention will furthermore emerge from the following description, given with reference to non-limitative examples.

Figure 1:
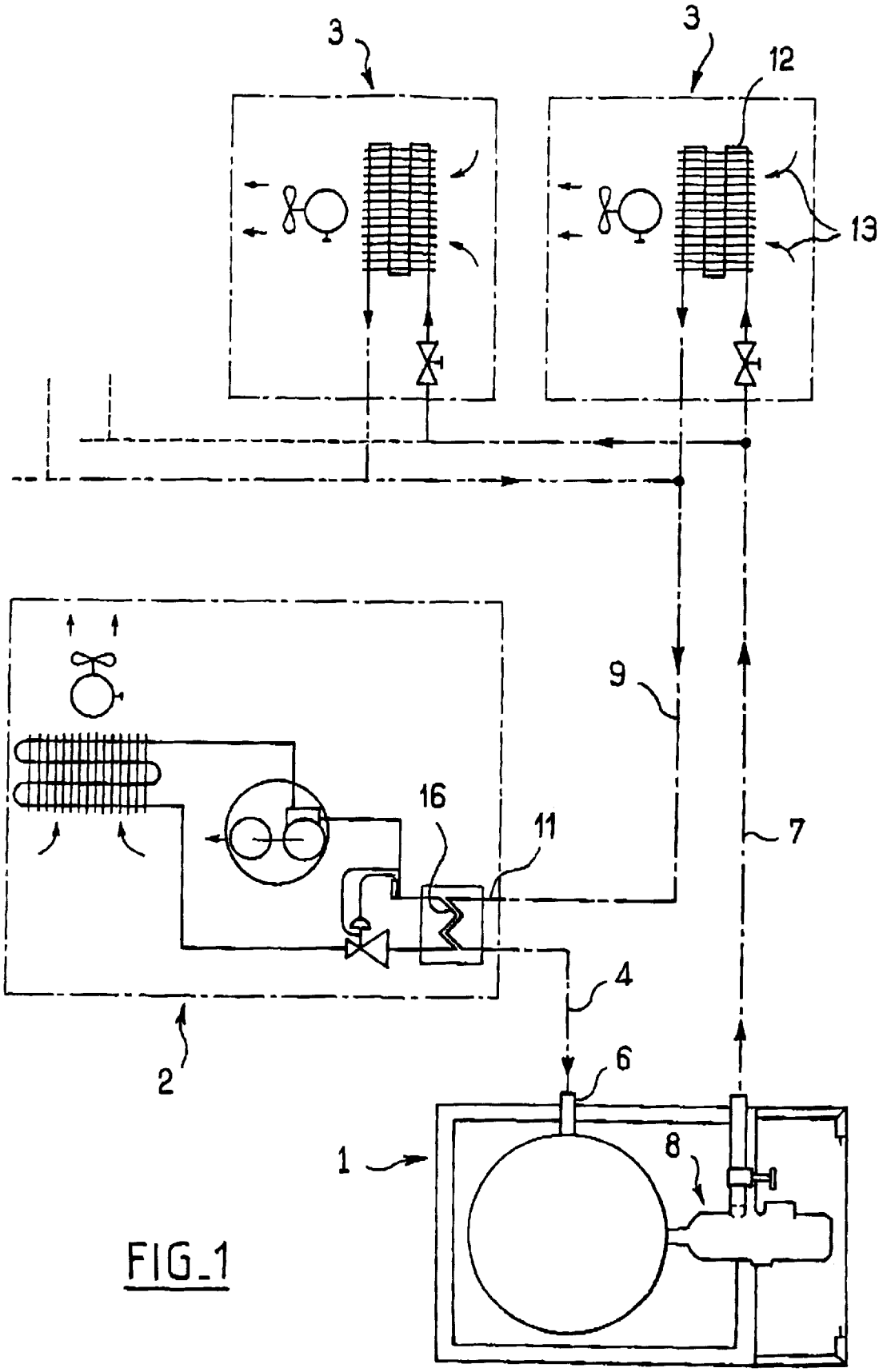
FIGS. 1 and 2 are two diagrams relating to two variants of an installation according to the invention.

In the example shown in FIG. 1, the thermal conditioning installation comprises a device for supplying heat transfer fluid 1, an equipment 2 forming a thermal source, and utilising devices 3. These elements 1, 2, 3 are interconnected by a pipe 4 going from the source 2 to a return pipe 6 of the supply device 1, a pipe 7 connecting a feed path 8 of the supply device 1 with the utilising devices 3, and a pipe 9 extending from the utilising devices 3 to the inlet 11 into the thermal source 2.

The installation therefore forms a closed circuit for the heat transfer fluid going from the supply device 1 to the utilising devices 3 and then to the thermal source 2 from where the fluid returns to the supply device 1. The utilising devices 3 are connected in parallel between the pipes 7 and 9 which serve them.

In the example shown, each utilising device 3 is illustrated in the form of an exchanger 12 with the ambient air 13. Each utilising device 3 tends to vary the temperature of the heat transfer fluid in the sense opposite to that of the temperature variation produced by the thermal source 2.

The thermal source 2 is illustrated in the form of a refrigeration machine in which one of the thermally active constituents 16 is in a heat-exchange relationship with the heat transfer fluid closed circuit.

Figure 2:
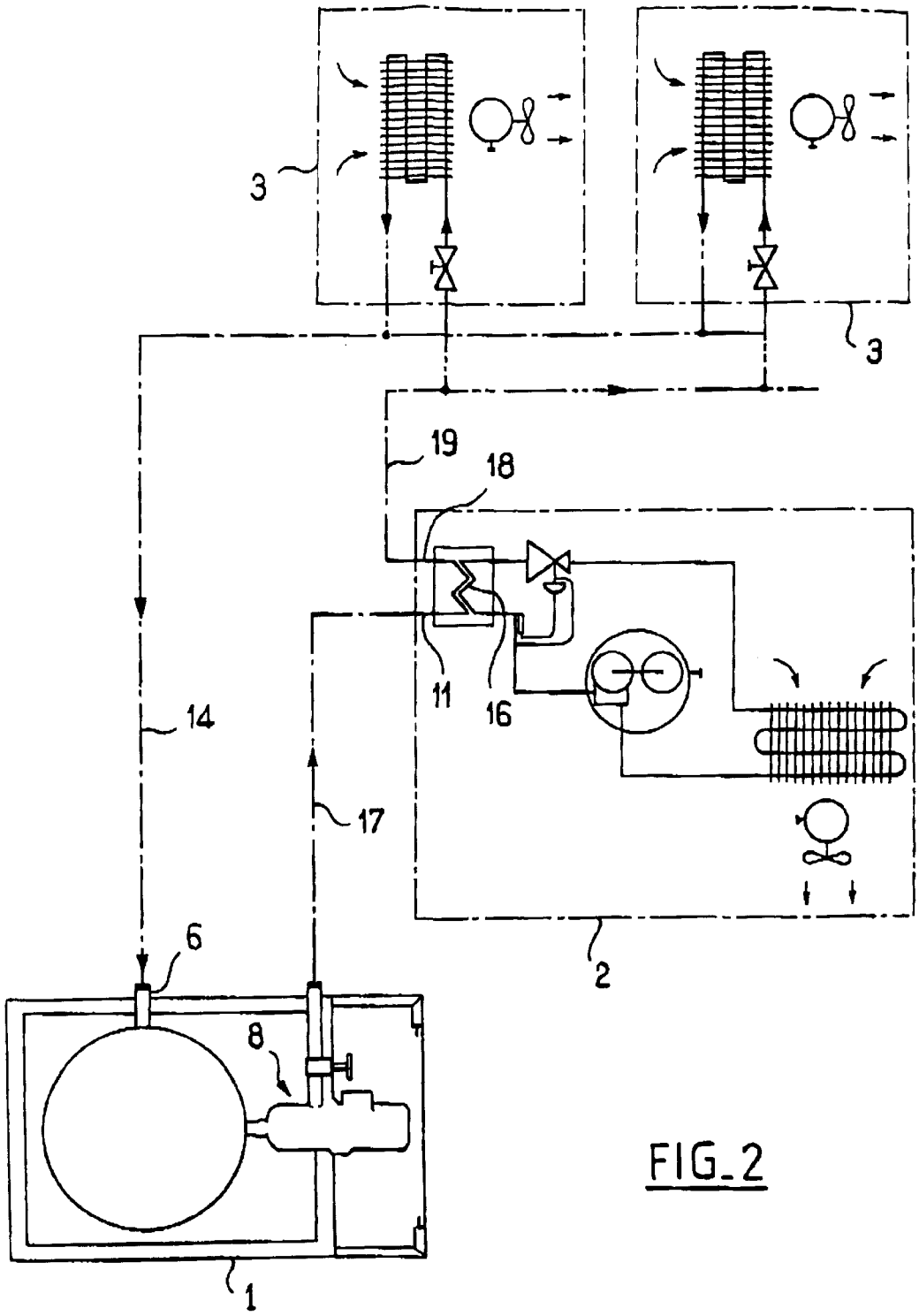

The example shown in FIG. 2 will be described only where it differs in comparison with that of FIG. 1.

In this example, the feed path 8 of the supply device 1 is connected by a pipe 17 to the inlet 11 of the thermal source 2 and the return path 6 of the supply device 1 is connected by a pipe 14 to the outlets of the utilising devices 3. A pipe 19 connects the outlet 18 of the thermal source 2 with the inlets of the utilising devices 3.

The supply device 1 will now be described in more detail referring principally to FIGS. 3 and 4.

The supply device 1 comprises a tank 21 of generally cylindrical shape disposed along a vertical axis in the example shown. The tank 21 comprises a return orifice 22 which connects with the return path 6 and a feed orifice 23 which connects with the feed path 8. The tank 21 forms part of the closed circuit for the heat transfer fluid. The return path 6 and the feed path 8 are connected with each other only by the tank 21 which, in service, is filled with heat transfer liquid. At its top the tank 21 has an automatic bleed device 24 for the automatic elimination of possible gas pockets. The tank 21 has the function of a thermal accumulator preventing sudden variations of temperature in the heat transfer fluid when the thermal source is started or stopped manually or automatically and when the consumption of the utilising devices 3 varies suddenly.

The supply device 1 furthermore comprises an expansion vessel 31 comprising a liquid chamber connected with the inside of the tank 21 by a pipe 32. In a conventional manner, the vessel 21 encloses a moving partition (not shown) separating the liquid chamber from a gas chamber whose pressure can be regulated through an access 33. In this way the pressure of the liquid in the tank 21 is at the same time regulated in a way which is independent of the variations in the volume of the liquid contained in the closed circuit of the installation.

The feed path 8 comprises pumping means produced in the shown example in the form of two centrifugal pumps 41 connected in parallel. The use of two pumps 41 is intended to avoid the risk of failure of the whole installation in the event of one of the pumps failing. Each pump 41 has an axial intake 42 connected to a respective feed orifice 23 of the tank 21. Each pump 41 also has a radial delivery orifice 43 connected to a common delivery pipe 44. In a way which is not shown, between each delivery orifice 43 and the delivery pipe 44 there is a non-return valve preventing one pump 41 in operation from delivering into another pump 41 which is stopped.

The delivery pipe 44 is equipped with a valve 51 for regulating the flow of the heat transfer liquid delivered by the pumps 41.

The tank 21 is installed in an enclosure 61 of generally parallelepipedic shape supported by a base 62 upon which stands a support 26 of the tank. The enclosure 61 comprises an outer shell 63, for example made of sheet steel. Against the inside face of the shell 63 is fixed a heat insulating lining 64 which covers it completely along the four lateral walls, under the top panel as well as over the frame 62. Additional lining 66 is provided inside the support 26. An air gap 67 is formed between the inside face of the lining 64 and the whole outside face of the tank 21. One of the side walls of the enclosure 61 comprises an opening 67 for an inspection hatch 68 which is also made thermally insulating.

The enclosure is made substantially fluid-tight in order to prevent as far as possible the entry of atmospheric water vapour and consequently the formation of a large quantity of condensation on the surface of the tank 21 and of the other cold parts located inside the enclosure. It is not possible however to avoid small entries of vapour and consequently the formation of a small quantity of condensation which runs towards the bottom of the enclosure. For this reason, there is provided in the bottom of the enclosure, above the lining 64 of the bottom, a collecting receptacle 68 equipped with an evacuation orifice 69.

A filter 81 is installed inside the tank 21 like a partition which is permeable to the heat transfer liquid, subdividing the interior of the tank 21 into a return chamber 27 connecting with the return orifice 22 and an feed chamber 28 connecting with the feed orifices 23. The filter 81 is for example made in the form of a grid of substantially circular shape, flat or preferably dish-shaped in order to resist the pressure difference between the chambers 27 and 28 by a vault effect. The filter 81 is welded all around its periphery to the inside face of the peripheral wall of the tank 21. The filter 81 is disposed in a horizontal plane.

The wall of the tank 21 is also traversed by two openings 29, one of them located just below and the other one just above the filter 81. As shown in FIG. 4, these openings 29 allow the fitting of heating elements 82 each one in the form of a rod which protrudes radially inside the tank 21 and are secured against the outer face of the wall of the tank 21 by a flange 83 which is extended outwardly by an electrical connection device 84. Such elements are intended to serve as a complementary source of heating in addition to the thermal source 2 if the latter is insufficient when it is operating as a heat source, or else is substituted for the thermal source 2 when the latter for example consists of a refrigeration machine which is not reversible as a heat pump, so that, despite this, the installation can operate as a heating installation for example during the winter period. The orifices 29 are oriented towards the inspection hatch 68.

Furthermore, an electrical heating mat 86 is secured against the outer face of the wall of the tank 21 in the vicinity of the feed orifices 23 because as this zone comprises many walls separating the heat transfer fluid from the gaseous space 67 inside the enclosure 63, it is more exposed to the risk of freezing.

The pumps 41, the expansion vessel 31, and the valve 51 are installed in a fluid-tight manner in appropriate openings of the enclosure 61, while extending through a same wall 71 of that enclosure. Said wall 71 simultaneously forms the back of a compartment 87 configured as a technical cabinet also housing the electrical box 88.

The power supply cable 89 (FIG. 4) of the heating mat 86 extends through the wall 71 of the enclosure in a fluid-tight manner and is connected to the electrical box 88. In a way which is not shown, the power supply cable of each element 82 can connect the connecting device 84 with the electrical box 88 via a cable which is for example grouped with the cable 89 for traversing the wall 71.

The assembly is such that the pump body 46 of each of the pumps 41 is inside the enclosure 61 whilst the motors 47 of the pumps 41 protrude into the compartment 87. The delivery path of the pumps 41 from the delivery orifices 43 and passing through the body 52 of the valve 51 extends in a plane parallel with the wall 71 traversed by the components 31, 41 and 51, close against the inside lining of this wall 71. The actuating device 53 of the valve 51 protrudes into the compartment 87 so that it is accessible and allows adjustment of the valve 51 from this compartment.

The expansion vessel 31 is installed in such a way that the cover 33 providing access to the adjustment means is in the compartment 87 to allow adjustment of the pressure of the tank 21 from the compartment 87.

The return pipe 6 and the delivery pipe 44 leave the enclosure through two orifices 72 formed through the same lateral wall 73 of the enclosure 61. The wall 73 is adjacent to the wall 71 through which the components 31, 41, 51 are mounted, and opposite the wall 74 equipped with the hatch 68. The return pipe 6 is a short pipe oriented radially with respect to the tank 21 and ending directly at the return orifice 22 located immediately behind the wall 73. The feed path 8 forms, as seen from above (FIG. 4), a 90° bend inside the pump body 46. The feed orifices 23 are oriented towards the wall 71, substantially at 90° to the return orifice 22 about the vertical axis of the tank 21, so that after the 90° turn in the pumps the feed path 8 ends at the same wall 73 as the return path 6, as has been described. The axis of the pumps 41 is horizontal and radial with respect to the tank 21. The inlet pipes 42 of the pumps 41 are very short straight pipes directed radially with respect to the axis of the tank 21. The delivery pipe 44 is also straight. If a single pump 41 were provided, all the pipes provided for the heat transfer fluid in the supply device 1 could be strictly straight. In the example shown, this very advantageous condition could not be achieved entirely due to the necessary connection between the deliveries of the two pumps 41.

Figure 5:
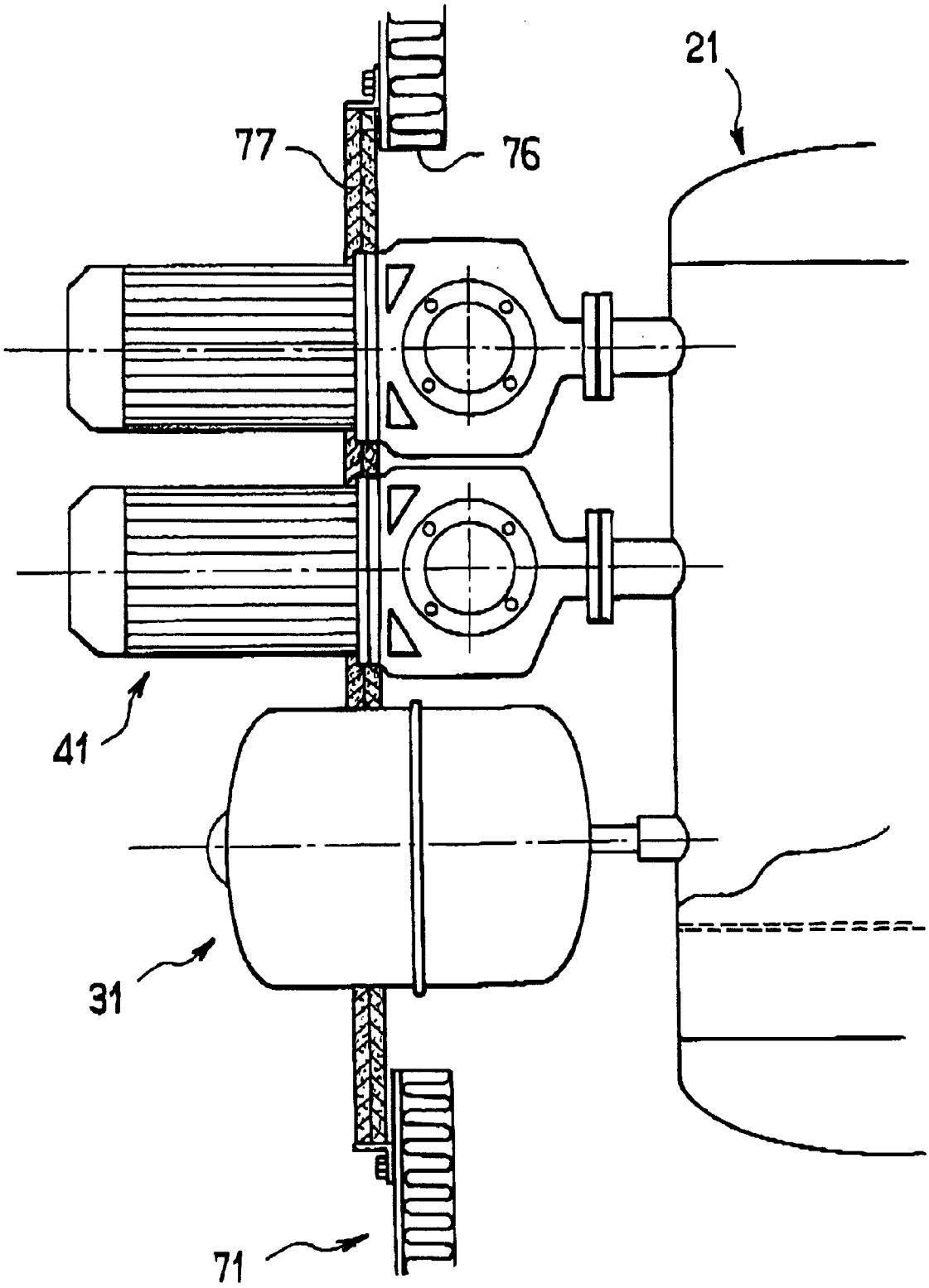
FIG. 5 is a view of a detail of FIG. 3, in a larger scale.

As shown in detail in FIG. 5, the wall 71 can, for the mounting of the components 31, 41, 51, have a large window 76 obturated by a heat insulating shield 77 through which the components 31, 41, and the valve 51 (not shown in FIG. 5) are mounted.

The operation and use of the supply device 1 will now be described.

When at least one of the pumps 41 is operating, the heat transfer liquid is taken in through the return orifice 22, enters into the tank 21 in the return chamber 27, passes through the filter 81 into the feed chamber 28 which it leaves through at least one of the feed orifices 23.

The impurities stopped by the filter 81 tend to drop spontaneously to the bottom of the tank 21 where they are in no way harmful. The temperature inside the enclosure 61 is close to that of the heat transfer liquid, which is generally regulated where it passes in contact with the thermal source 2 (FIGS. 1 and 2). The heat dissipated by the motors 47 remains outside.

If this temperature becomes close to 0, the heating mat 86 can be put into operation automatically in order to prevent freezing at the intakes of the pumps.

Such a supply device can operate for years without necessitating any maintenance inside the enclosure 61. If it is desired to clean the inside of the tank 21, the latter is drained through a bottom tap which is not shown, the two elements 82 are removed and a suction nozzle is introduced through the corresponding openings 29 in order to unclog the return chamber 27 and the feed chamber 28 respectively, including both sides of the filter 81. This operation is facilitated by the fact that the openings 29 are opposite the hatch 68.

The supply device is particularly economic to manufacture, very practical in use and minimises maintenance and head losses undergone by the heat transfer fluid.

The example shown in FIG. 6 will be described only where it differs with respect to the one in FIG. 1.

In this example, a section 101 of the thermal source 2 is an integral part of the hydraulic supply device 1 and is integrated inside the enclosure 61 and in particular inside the volume surrounded by the heat insulating lining 64.

More particularly, the section 101 of the thermal source 2 which is inside the enclosure 61 comprises the refrigeration compressor 103, a refrigeration fluid tank 106, a refrigeration fluid pressure relief device 107 and a device 116 serving as an evaporator for the refrigeration fluid and as a cooling exchanger for the heat transfer liquid. The pipe 17 is now entirely inside the enclosure 61 between the delivery of the pump 41 and the inlet into the evaporator-exchanger 116. The outlet 118 of the evaporator-exchanger 116 consists of a pipe which emerges outside of the enclosure 61 through the same face of the enclosure 61 as that on which the connector 6 for return to the inside of the tank 21 is located.

As regards the refrigeration circuit, the delivery 108 of the compressor 103 consists of a pipe which traverses the wall of the enclosure 61 and then is connected to the inlet of the condenser 104 which constitutes the essential element of the section 102 of the thermal source 2 which is located outside of the enclosure 61. An outlet pipe 109 of the condenser 104 also passes through the enclosure 61 and is then connected to the refrigeration fluid tank 106. The region 106f of the tank 106 which is located below the liquid level in this tank is connected through the pressure relief device 107 with the inlet of the evaporator section of the evaporator-exchanger 116. The outlet of this evaporator section is connected by a pipe 111 with the inlet of the compressor 103.

The advantage of this embodiment is that the parts of the refrigeration machine and more generally of the thermal source which also need to be heat insulated are also grouped inside the insulated enclosure 61. In this way the problems of heat insulation in the installation are greatly simplified, a major portion of the technical components of the installation are grouped inside a same enclosure and external insulation is dispensed as regards elements such as the compressor or the evaporator, which makes these elements more accessible for maintenance.

Thermodynamically speaking, the compressor operates for compressing the refrigeration fluid up to a temperature which can be rather high. Practically however, the compressor nevertheless constitutes a cold section of the installation because it is usually maintained at low temperature by a cooling system using the vapour coming from the evaporator of the refrigeration circuit just before its inlet into the compression chamber of the compressor.

In a way which is not shown, inside the enclosure 61 there are also the regulating devices, if any, of the refrigeration machine, such as the regulation of the throttle carried out by the pressure relief device 107 for the refrigeration fluid flowing therethrough.

Figure 3:
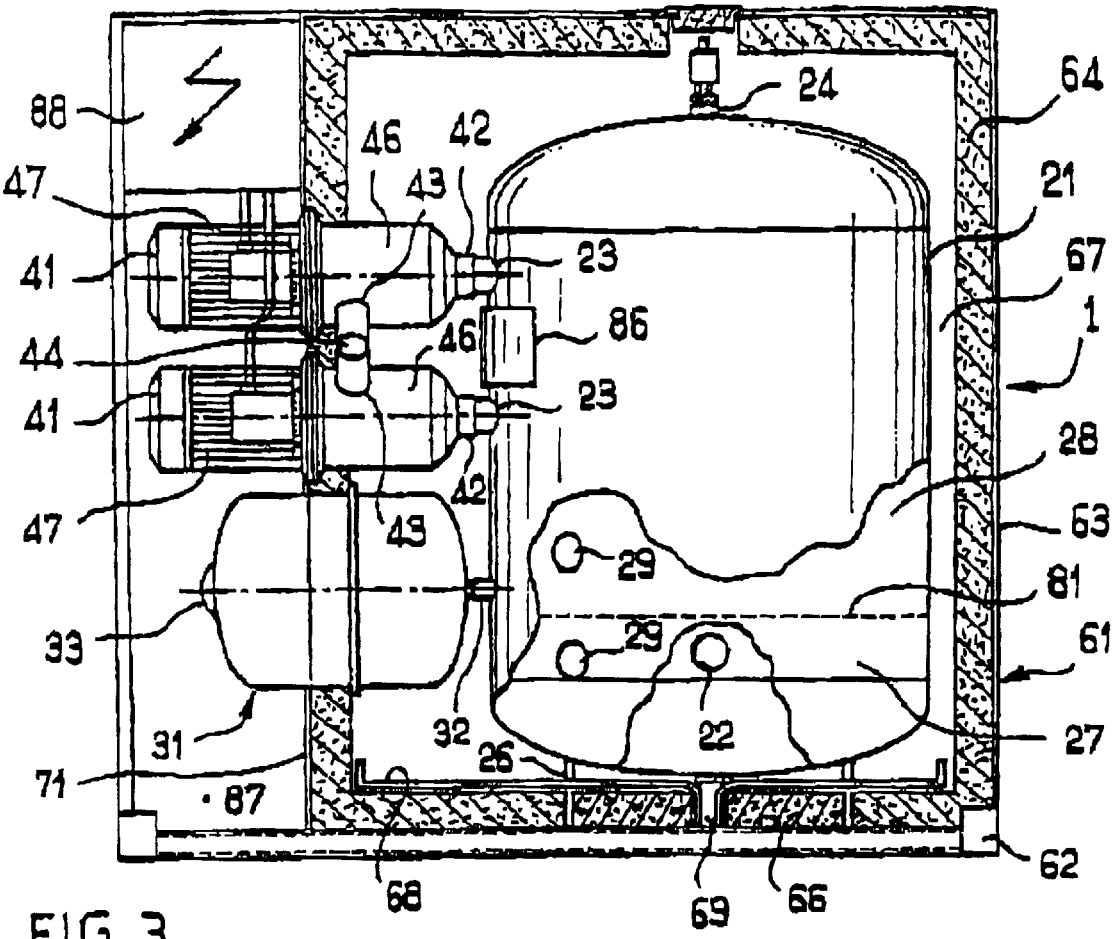
FIG. 3 is a side view of the supply device according to the invention, with a vertical cross-section of the enclosure and tear-aways of the tank.
Figure 4:
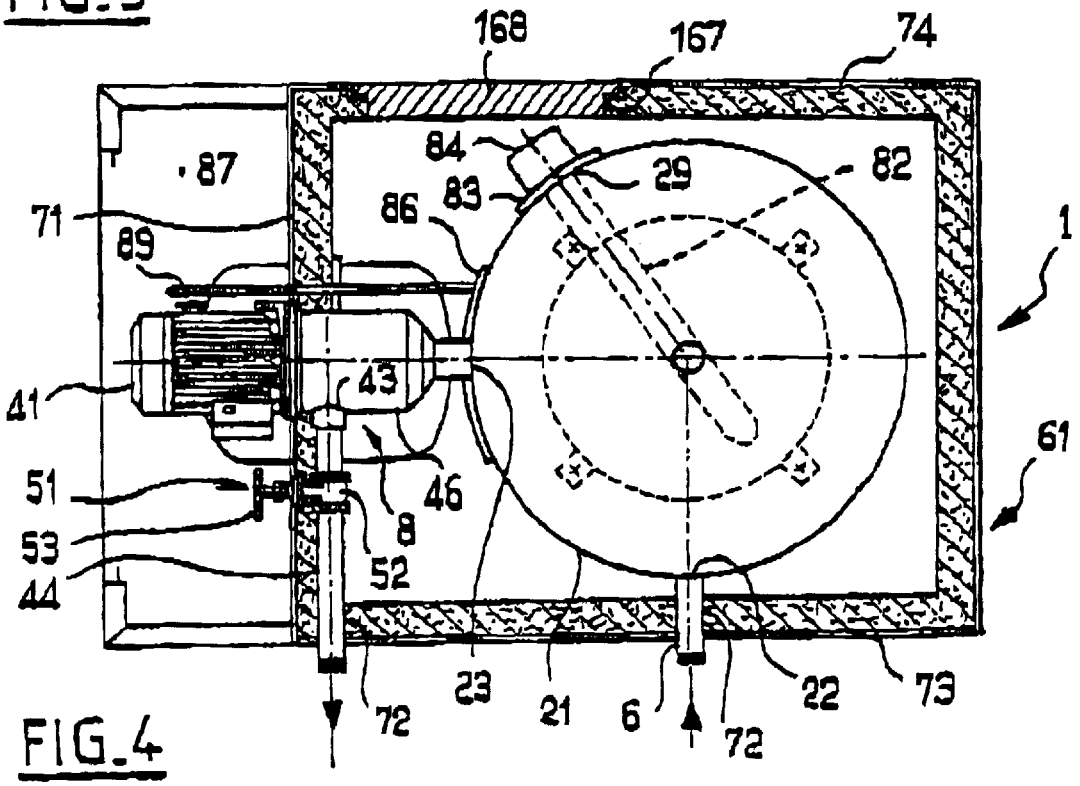
FIG. 4 is a top view of the supply device of FIG. 3, with a horizontal cross-section of the enclosure.
Figure 6:
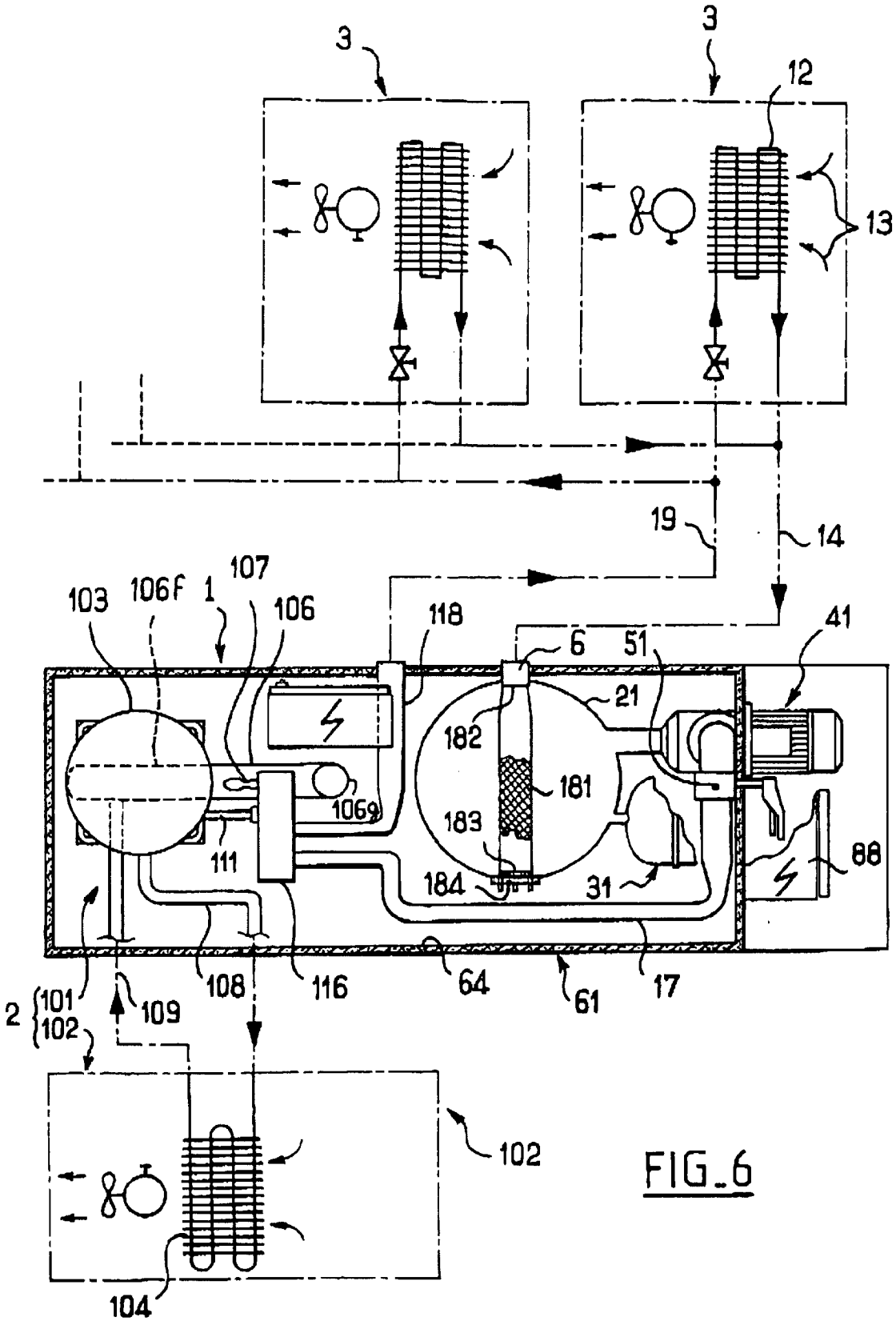
FIG. 6 is a view similar to FIG. 2, but relating to another embodiment.

Independently from the above, the embodiment of FIG. 6 also distinguishes from that of FIG. 3 in that there is mounted inside the enclosure 61, a different filter 181 of cylindrical shape having an annular edge 182 surrounding the return orifice 6 and, at the opposite end, an annular edge 183 surrounding an inspection orifice 184 formed in the wall of the tank 21, and normally obturated by a closing plate. When the pump 41 is operating, it produces a depression inside the tank 21. The cylindrical shape of the filter 181 has an excellent resistance to the bursting stress which results from this depression, particularly when the filter is clogged. At the same time, the production of a cylindrical filter is inexpensive. The inspection hole 184 conveniently allows insertion of a heating element, or of a suction nozzle for cleaning purposes, or else allows replacement of the filter 181.

Figure 7:
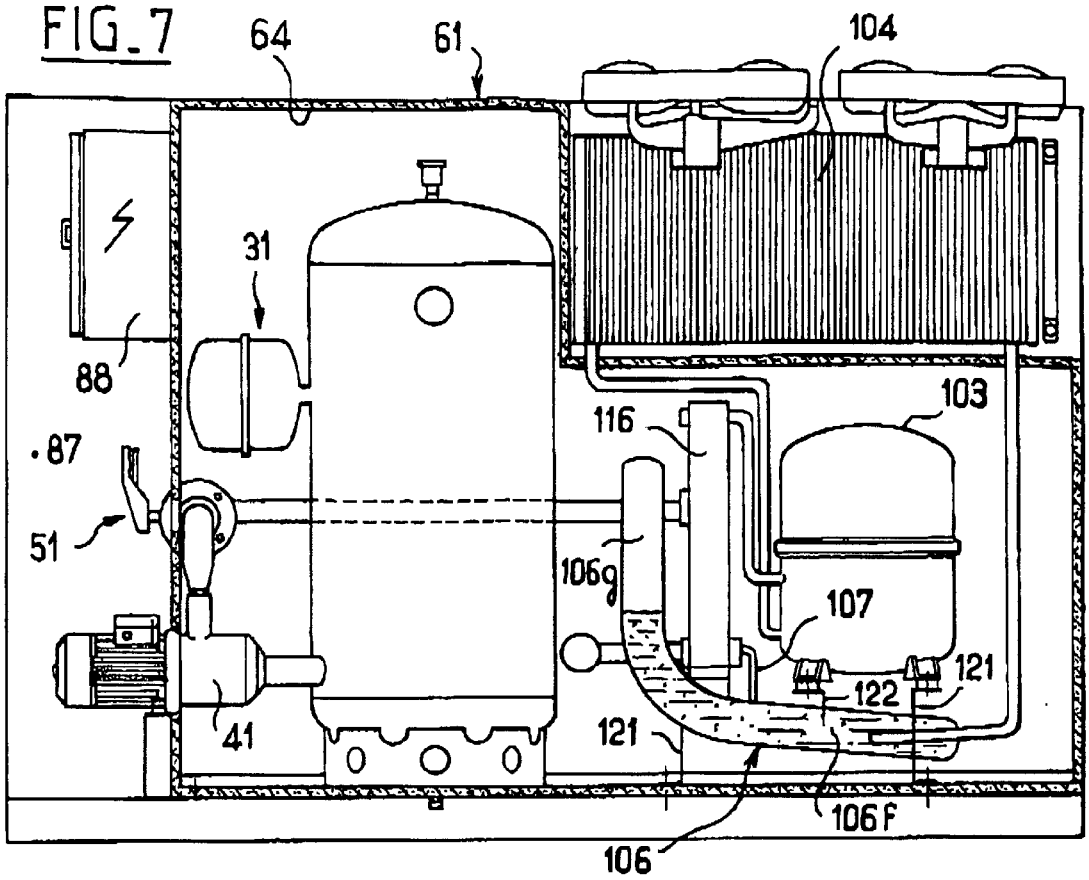
FIG. 7 is a view similar to FIG. 3, but relating to a possible embodiment of the supply device of FIG. 6.

In the embodiment shown in FIG. 7, the condenser 104, instead of being physically separated from the enclosure 61, is secured to the latter, on the outside of the heat insulation lining 64.

Furthermore there can be seen on this figure, better than in FIG. 6, the particular embodiment of the refrigeration tank 106 in the form of an elongated bottle with a substantially vertical upper region 106*g*, intended to contain the gaseous phase and a lower region 106*f* intended to contain the liquid phase and which forms an obtuse angle of about 100°, thereby to be virtually horizontal. The region 106*f* is integral with supports 121 which extend upwards in order to also support the evaporator-exchanger 116 and the compressor 103. Another support 122 of the compressor 103 stands solely on the tank 106. FIG. 6 shows that the gaseous region 106*g* is connected to the delivery 108 of the compressor 103 by a connecting pipe 123.

Figure 8:
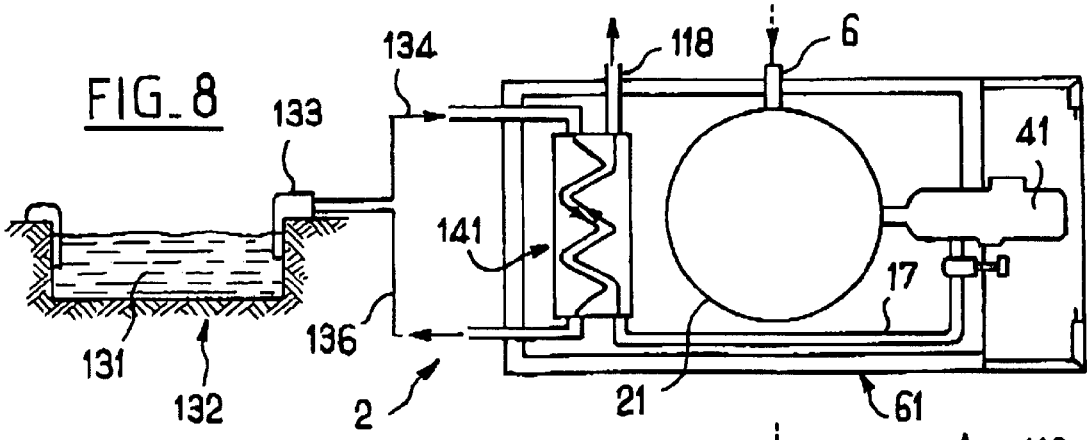
FIGS. 8 and 9 are two plan-view diagrams relating to two other embodiments of the hydraulic supply device.

In the example shown in FIG. 8, the thermal source 2 is no longer a refrigeration machine but a system of heat exchange with the water 131 of a swimming pool 132 having a water treatment device 133. Such a treatment device takes water from the swimming pool 132 and subjects it to cleaning and filtration treatments etc. The water is then returned to the swimming pool 132. In this version of the invention, the water flowing through the treatment device 133 is diverted into the enclosure 61 through an inlet pipe 134 and then returns to the treatment device 133 through a return pipe 136. In the enclosure 61, the water from the swimming pool flows through a heat exchanger 141 whose other path is traversed by the delivery 17 of the pump 41 upstream of the orifice 118 for feeding the heat transfer fluid out of the enclosure 61.

Starting from the orifice 118, the heat transfer fluid can go directly to the utilising devices or can pass through a refrigeration machine intended to further lower its temperature.

Figure 9:
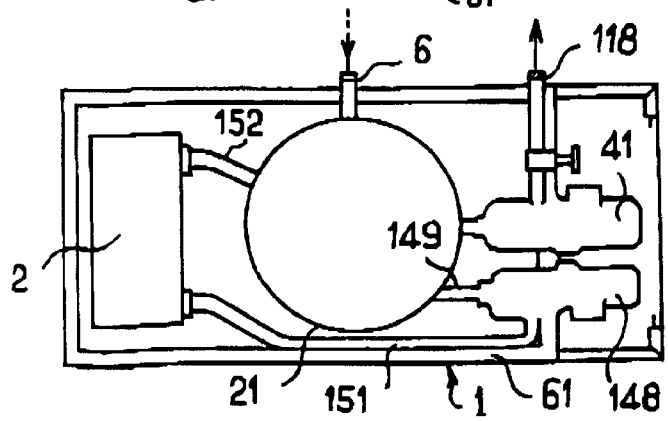

In the example shown in FIG. 9, the heat transfer fluid has two separate circuits. A first circuit simply provides for the circulation of the heat transfer fluid from the tank 21 through the pump 41 to the utilising devices and the return through the inlet orifice 6 into the tank 21. The other circuit comprises a second pump 148 with an intake 149 in the tank 21, and a delivery 151 into the thermal source 2 which can, as shown, be at least partly located inside the enclosure 61. From the source 2, the heat transfer fluid returns directly to the tank 21 through a pipe 152.

This invention is not of course limited to the examples shown and described.

In particular, the device can, with minor modifications, be installed in such a way that the axis of the tank 21 is horizontal. The filter 81 is then, without disadvantage, disposed in a vertical plane.

What is claimed is:

1. A hydraulic supply device for an installation having a refrigerating function and using a heat transfer fluid in a closed circuit, said device comprising:

circuit components containing cooled heat transfer fluid in operation of the refrigerating function, said circuit components comprising enclosed components having at least a portion thereof which is housed within a substantially fluid-tight and heat-insulated enclosure which brings said enclosed components together in order to form a hydraulic unit; and an air space between an outside face of said enclosed components and said enclosure.

2. A device according to claim 1, wherein the enclosure has an inside face covered with a heat insulation lining.

3. A device according to claim 1, wherein the heat insulation lining is not intrinsically fluid-tight.

4. A device according to claim 1, wherein said enclosed components comprise a tank having a return orifice and a feed orifice.

5. A device according to claim 1, further including a device for collecting condensation water in a bottom region of the enclosure.

6. A device according to claim 4, further including a filter fitted inside the tank forming a permeable partition which subdivides the inside of the tank into a return chamber connected to the return orifice and a feed chamber connected to the feed orifice.

7. A device according to claim 6, wherein the tank comprises, through its wall in the vicinity of the filter, at least one opening for fitting of a heating element and/or introduction of a suction nozzle for cleaning the filter.

8. A device according to claim 6, wherein the filter, of generally flat or dished shape, comprises a peripheral edge secured to a peripheral wall of the tank.

9. A device according to claim 6, wherein the return chamber is in a lower position under the feed chamber.

10. A device according to claim 6, wherein the filter is of cylindrical shape with an annular edge surrounding one of the inlet and feed orifices, and preferably, at the opposite end, an annular edge surrounding an inspection hole provided through the will of the enclosure.

11. A device according to claim 1, wherein said enclosed components include an expansion vessel mounted through a wall of the enclosure, in such a way that an adjustment device of the expansion vessel is accessible from outside the enclosure.

12. A device according to claim 1, wherein said enclosed components include a pump mounted through a wall of the enclosure in such a way that the motor of the pump is outside the enclosure.

13. A device according to claim 4, wherein said enclosed components include a pump mounted along a substantially horizontal axis, with an axial inlet directed towards the feed orifice of the tank and a substantially radial delivery pipe, the delivery pipe emerging through a same wall of the enclosure as a return pipe connected to the return orifice of the tank, the return orifice oriented towards said same wall of the enclosure.

14. A device according to claim 13, wherein the delivery pipe of the pump extends along a wall of the enclosure adjacent to the one where the delivery pipe emerges.

15. A device according to claim 14, wherein said enclosed components furthermore comprise in said delivery pipe, a regulating valve mounted through the enclosure such that an actuation device of the valve is accessible from outside the enclosure.

16. A device according to claim 1, wherein said enclosed components comprise certain components mounted through a same wall of the enclosure.

17. A device according to claim 16 wherein said certain components appear outside of the enclosure in a compartment adjoining the enclosure.

18. A device according to claim 1 further including inside the enclosure, at least part of a refrigerating machine of the installation.

19. A device according to claim 18, wherein said part of the refrigerating machine which is included within the enclosure comprises at least part of at least one of: a refrigeration compressor, a heat exchanger between a refrigeration fluid and the heat transfer fluid, a pressure reducer and a heat transfer fluid tank.

20. A device according to claim 19, furthermore comprising an exchanger between the refrigeration fluid and atmospheric air, said exchanger being mounted outside the enclosure and being at least indirectly secured thereto.

21. A device according to claim 18, wherein said part of the refrigerating machine which is included inside the enclosure comprises a heat exchanger between the heat transfer fluid and a fluid circuit such as the water treatment circuit of a swimming pool.

22. A device according to claim 4, wherein the tank is connected to a source circuit and to a separate utilization circuit, each one provided with its respective pumping means.

23. An installation having a refrigerating function and including a hydraulic supply device according to claim 1.

24. A hydraulic supply device for an installation using a heat transfer fluid in a closed circuit, said device comprising:

components containing heat transfer fluid, at least in use; and a substantially fluid-tight and heat-insulated enclosure which houses at least some of said components, wherein at least one of said components is mounted through a wall of said enclosure so as to have a first portion inside the enclosure and a second portion outside thereof.

25. A hydraulic supply device according to claim 24, wherein said at least one component is a pump for said heat transfer fluid, said second portion thereof being a motor of the pump.

26. A hydraulic supply device according to claim 24, wherein said second portion comprises control means.

27. A hydraulic supply device according to claim 24, wherein said at least one component comprises plural components, the second portions of which emerge from a same wall of the enclosure, which same wall forms a back wall of a compartment adjoining said enclosure.

28. A hydraulic supply device according to claim 24, wherein said enclosure also accommodates at least part of a refrigerating machine.

* * * * *